United States Patent [19]

Casad et al.

[11] Patent Number: 4,876,449

[45] Date of Patent: Oct. 24, 1989

[54] RESERVOIR EVALUATION USING PARTITIONING TRACER

[75] Inventors: Burton M. Casad; Preston L. Gant, both of Ponca City, Okla.

[73] Assignee: Conoco Inc., Ponca City, Okla.

[21] Appl. No.: 193,471

[22] Filed: May 12, 1988

[51] Int. Cl.[4] ..... G01V 5/00

[52] U.S. Cl. ..... 250/259; 250/260

[58] Field of Search ..... 250/259, 260

[56] References Cited

U.S. PATENT DOCUMENTS

| | | | |
|---|---|---|---|
| 3,623,842 | 12/1969 | Deans | 66/252 |
| 3,894,584 | 7/1975 | Fertl | 250/260 |
| 4,071,756 | 1/1978 | Casad | 250/260 |
| 4,124,800 | 11/1978 | Mitchell et al. | 250/260 |
| 4,349,737 | 9/1982 | Smith et al. | 250/259 |

*Primary Examiner*—Janice A. Howell
*Assistant Examiner*—T. Nguyen

[57] ABSTRACT

Reservoir information for determining residual oil saturation is obtained by injection of a partitioning tracer and a non-partitioning material through an injection well and periodically logging a second well spaced from the injection well to determine time of passage and amount of said injected materials. A preferred partitioning tracer is iodoethanol containing iodine 131, and the second material may be a radioactive tracer having a gamma ray emission spectrum different from the partitioning tracer or it may be a brine having a salinity different from that of formation water in the reservoir.

10 Claims, No Drawings

RESERVOIR EVALUATION USING PARTITIONING TRACER

BACKGROUND OF THE INVENTION

1. Field of the Invention

This invention relates to methods of determining residual oil saturation in watered out oil reservoirs, and more particularly relates to a method of using a partitioning tracer and a non-partitioning tracer in combination with logging techniques to obtain information used to determine residual oil saturation in a reservoir.

The determination of the amount of oil in subterranean reservoirs has been a subject of considerable interest to the oil industry for many years. Such information is obviously of interest in the case of a newly discovered reservoir which is to be produced, and is of even greater interest in the case of a reservoir which has been subjected to primary production and possibly secondary production. In recent years the increased interest in recovering additional quantities of oil from reservoirs which have been subjected to primary and secondary production, by enhanced recovery methods such as surfactant flooding and the like, has increased. Since such enhanced oil recovery methods are quite expensive, it is important that a method be available for determining the amount of residual oil in a formation to be subjected to enhanced recovery prior to the initiation of the enhanced recovery operation. The residual oil present in reservoirs which have been subjected to primary or secondary recovery is oil which remains in place after waterflooding operations, or after water flushing by a strong water drive or the like. Such residual oil is trapped in the formation pores or otherwise retained in the formation by various mechanisms many of which are only partially understood at the present. In any event, such oil while recoverable in many instances by enhanced recovery operations is not recoverable by natural water drive or by conventional waterflooding operations.

As a result of the increasing interest in the recovery of additional quantities of oil from reservoirs which have been subjected to waterflooding operations, the oil industry has directed a continuing effort to the development of improved methods for determining the amount of residual oil in such formations.

The present invention provides a method for obtaining information useful in determining the residual oil saturation in a reservoir.

2. Prior Art

There are several methods which are currently used to obtain the fluid saturations of a formation. Coring of the reservoir is one commonly used technique for acquiring this information. Coring is accomplished by drilling into the reservoir and obtaining a sample of the formation rock, saturated with its fluids, which is cut from the formation and removed to the surface where its fluid content can be analyzed. This method, however, is susceptible to faults of the sampling technique; thus, the sample taken may not be representative of the formation as a whole. Also, there is a high likelihood that the coring process itself may change the fluid saturation of the extracted core. Moreover, coring can only be employed in newly drilled wells or open hole completions. In the vast majority of wells, casing is set through the oil-bearing formation when the well is initially completed. Core samples, therefore, cannot be subsequently obtained from such a well. Finally, coring by its very nature only investigates the properties of the formation rock and fluids in the core itself, and this data cannot always be extrapolated with accuracy to areas of the formation removed from the well.

Another approach for obtaining reservoir fluid saturations is by interpretation of well logs. While this technique is relatively simple and inexpensive to carry out, logging investigates the formation for only a short distance beyond the well bore. Moreover, the logs are a measure of the properties of the rock-fluid system as an entity, and it is difficult by this approach to differentiate between the properties of the rock and its fluids.

Fluid saturations can also be approximated by material balance calculations based on production histories. However, estimates of fluid saturations made by this method are subject to even greater error than coring or logging since the initial fluid saturation must be determined by some other technique and an accurate history of the quantity and source of the produced fluids independently obtained.

U.S. Pat. No. 3,623,842 to Deans proposes a method for measuring fluid saturations in a hydrocarbon-bearing formation containing a mobile fluid and an immobile fluid. In that method, a carrier liquid containing a reactant tracer material is injected into the formation and displaced away from the well. The reactant material is permitted to remain at rest in the formation for a period of time. During this "soak period" at least a part of the reactant reacts to form a product having a different partition coefficient between the carrier fluid and the immobile phase than the reactant material. Subsequently, the carrier fluid, the unconsumed reactant and the reaction product are displaced through the formation, preferably to the injection well by produced fluids. Since the reactant and the product have differing partition coefficients between the mobile and the immobile phases, they are chromatographically retarded in their passage through the formation by different amounts which are a function of the saturation of the immobile fluid phase. By detecting the presence of the reactant and the product in the produced fluids and analyzing these results by chromatographic techniques, the relative proportions of mobile and immobile fluids in the formation can be determined.

While the proposed reacting tracer method overcomes some of the disadvantages of the other known methods for determining fluid saturations, other disadvantages are encountered which adversely affect the accuracy and utility of this method. For example, where the unreacted material is employed as one of the tracers, the method requires the use of a reactant material that is only partially reacted under the reservoir conditions so that both the reactant material and the product are present in the produced fluids in detectable quantities. It is difficult to select a reactant material that exhibits a desired partition coefficient, that only partially reacts under a wide variety of reservoir conditions to form a product having a suitable, but different partition coefficient, and in which both the reactant and the product are present in detectable quantities in the recovered fluids. In order that detectable concentrations of both the reactant and the product materials be obtained, it is often necessary to increase the concentration of the reactant material in the injected carrier liquid. Also, the residence time that the tracer materials are in the reservoir must be carefully controlled to obtain sufficient reaction to provide a detectable concentration of product, yet retain detectable concentrations of reactant. This is difficult and costly to carry out because of the increased chemical usage, difficulty in finding suitable tracers, difficulty in predicting reaction conditions, and because of the careful control of residence or exposure time that is required. Thus, need exists for a simplified method for obtaining reservoir information which can be used to determine fluid saturations in a petroleum reservoir.

U.S. Pat. No. 4,071,756 describes a method for determining residual oil saturation utilizing programmed injection of a first water soluble radioactive tracer and a second partitioning tracer in conjunction with known logging techniques.

While the procedures described in the above-discussed references have been useful to an extent, there has been a continuing need for improved methods of obtaining data which enables the determination of residual oil saturation in a watered out reservoir.

SUMMARY OF THE INVENTION

According to the present invention, an improved method of obtaining reservoir information is provided based on the fact that the rate of advance of a chemical system that partitions between oil and water is dependent on both the partitioning coefficient of the chemical and the residual oil saturation in the rock. The rate of advance of a water soluble oil insoluble chemical is dependent only on the pore space available for water flow and the rate of injection. Thus, if two such chemicals are injected in a well and flow to or by a second well, the separation of the chemical peaks can be useful in determining the oil saturation between the two wells. This invention provides a method of determining the arrival times and curve shape of selected chemicals by logging a second production or observation well which is spaced from the injection well. The process is not limited to a two-well geometry.

DESCRIPTION OF THE PREFERRED EMBODIMENTS

One preferred embodiment of the invention involves injection of a partitioning radioactive tracer, such as iodoethanol containing radioactive iodine 131, in an aqueous solution with a second radioactive tracer soluble only in water, i.e. a cobalt 60 cyanide complex. Then, an observation well is periodically logged using a spectra gamma ray logging tool. This instrument can detect arrival of and determine the amount of each of the radioactive compounds as they pass the observation well. This data can then be used to determine the residual oil saturation very accurately.

Another preferred embodiment of the invention involves injection of a radioactive partitioning tracer chemical in an aqueous solution having a salinity markedly different from that of the reservoir brine. Induction logging of a production or observation well detects arrival of and amount of the injected brine over a period of time, and gamma logging of the production or observation well determines arrival of and amount of the partitioning tracer over a period of time. The resulting data can then be used similarly to the embodiment where two radioactive tracers are used.

The use of iodoethanol labeled with iodine 131 is a preferred partitioning tracer, but other radioactive partitioning tracers including those set forth in U.S. Pat. No. 4,071,756 could be used. The use of a cobalt cyanide complex labeled with cobalt 60 is preferred when the second injected material which is not soluble in oil is a radioactive tracer, but other oil insoluble tracers including those set forth in U.S. Pat. No. 4,071,756 could be used.

In the embodiment where the second injected material is fresh water or a brine having a salinity different from the salinity of the reservoir brine, the material can be of either greater or lesser salinity than the reservoir brine, although in actual practice this procedure may not often be practical, as the injected water in most treatments is water previously produced from the formation being studied. Nevertheless, there are instances where injection of water or brine as the second material may be practical.

It is not essential that both tracers be injected simultaneously, but it is preferable to do so as this simplifies the calculations used in determining the residual oil saturation. The arrival times and concentration profiles of the two injected materials can be determined by a series of logging operations, and any desired pattern and combination of injection and production wells may be used. The wells or wells which are logged are spaced from the injection well or wells, and may or may not be "observation" wells as distinguished from production wells. In some respects, improved accuracy can be expected if the logged wells are observation wells rather than producing wells, as in that case the possibility of fluid drift in the vicinity of the wellbore is less likely. The term "observation well" as used herein refers to a wellbore extending into the reservoir being studied, but not an injection or production well. Preferably, an observation well is in line between an injection well and a production well.

It is a particular advantage of this invention that residual oil saturation can be determined without disturbing the oil in place, and the need for obtaining and analyzing samples of formation rock and/or fluids is eliminated. The procedure can provide useful reservoir information as to properties other than residual oil saturation, such as porosity, vertical conformance, etc.

We claim:

1. A method of obtaining information about a watered-out oil reservoir comprising:

(a) injecting into a first well (1) a partitioning radioactive tracer material having a first gamma ray emission spectrum, and (2) a water-soluble non-partitioning radioactive tracer material having a different gamma ray emission spectrum; and (b) periodically logging a second well spaced from said injection well to detect arrival of and amount of said tracer materials.

2. The method of claim 1 wherein said partitioning tracer is iodoethanol containing iodine 131.

3. The method of claim 2 wherein said non-partitioning tracer contains cobalt 60.

4. A method of obtaining information about a watered-out oil reservoir comprising:

(a) injecting into said reservoir through a first well a partitioning radioactive tracer material having a gamma ray emission spectrum;

(b) injecting into said reservoir through said first well a second material which is substantially insoluble in oil and which can be detected and distinguished from formation water and from said partitioning tracer by logging; and (c) periodically logging a second well spaced from said injection well to detect arrival of and amount of said injected materials.

5. The method of claim 4 wherein said radioactive tracer is iodoethanol containing iodine 131.

6. The method of claim 5 wherein said second material is a brine having a salinity different from that of the reservoir water.

7. The method of claim 5 wherein said second material is an aqueous solution of a radioactive cobalt compound.

8. The method of claim 6 wherein said logging includes gamma ray logging to detect said partitioning tracer and induction logging to detect said brine.

9. The method of claim 7 wherein said logging consists of gamma ray logging.

10. The method of claim 4 wherein said logging is done through at least one observation well.

* * * * *